US012630999B2

(12) United States Patent
Flatz et al.

(10) Patent No.: US 12,630,999 B2
(45) Date of Patent: May 19, 2026

(54) WORK IMPLEMENT WITH A MECHANICAL DIAPHRAGM WALL GRIPPER AND METHOD FOR CARRYING OUT A WORKING STEP OF SUCH A WORK IMPLEMENT

(71) Applicant: Liebherr-Werk Nenzing GmbH, Nenzing (AT)

(72) Inventors: Lukas Flatz, Altach (AT); Mathias Blank, Satteins (AT); Tobias Glück, Vienna (AT); Bernhard Bischof, Vienna (AT); Andreas Kugi, Vienna (AT)

(73) Assignee: LIEBHERR-WERK NENZING GMBH, Nenzing (AT)

( * ) Notice: Subject to any disclaimer, the term of this patent is extended or adjusted under 35 U.S.C. 154(b) by 363 days.

(21) Appl. No.: 18/465,837

(22) Filed: Sep. 12, 2023

(65) Prior Publication Data

US 2024/0102262 A1 Mar. 28, 2024

(30) Foreign Application Priority Data

Sep. 16, 2022 (DE) ..... 10 2022 123 785.0

(51) Int. Cl.
*E02F 3/47* (2006.01)
*E02F 3/60* (2006.01)

(52) U.S. Cl.
CPC . *E02F 3/47* (2013.01); *E02F 3/60* (2013.01)

(58) Field of Classification Search
CPC ..... E02F 3/47; E02F 3/60
See application file for complete search history.

(56) References Cited

U.S. PATENT DOCUMENTS

2020/0207596 A1 7/2020 Hausladen et al.
2025/0137225 A1* 5/2025 Schuell ..... E02D 17/13

FOREIGN PATENT DOCUMENTS

| | | | |
|---|---|---|---|
| DE | 4335479 | A1 | 5/1994 |
| DE | 19806047 | A1 | 9/1998 |
| DE | 19955750 | A1 | 5/2001 |
| EP | 3725955 | A1 | 10/2020 |
| EP | 3678975 | B1 | 4/2021 |
| EP | 3854943 | A1 | 7/2021 |
| FR | 2785946 | A1 | 5/2000 |
| JP | H0726414 | B2 | 3/1995 |

* cited by examiner

*Primary Examiner* — Matthew R Buck
(74) *Attorney, Agent, or Firm* — McCoy Russell LLP

(57) ABSTRACT

The disclosure relates to an work implement, in particular a cable excavator, comprising a mechanical diaphragm wall gripper with two gripper buckets, which is suspended on the work implement by means of a hoisting cable and a closing cable, a hoisting cable winch on which the hoisting cable can be wound up and unwound for adjusting the diaphragm wall gripper, in particular substantially vertically, a closing cable winch on which the closing cable for actuating the gripper buckets is mounted so that it can be wound up and unwound, a measuring device with at least one sensor for detecting a current position, speed and/or acceleration, a control unit connected to the measuring device, via which the hoisting and closing cable winches can be actuated, and an input means connected to the control unit for controlling the diaphragm wall gripper.

15 Claims, 3 Drawing Sheets

WORK IMPLEMENT WITH A MECHANICAL DIAPHRAGM WALL GRIPPER AND METHOD FOR CARRYING OUT A WORKING STEP OF SUCH A WORK IMPLEMENT

CROSS REFERENCE TO RELATED APPLICATION

The present application claims priority to German Patent Application No. 10 2022 123 785.0 filed on Sep. 16, 2022. The entire contents of the above-listed application are hereby incorporated by reference for all purposes.

TECHNICAL FIELD

The present disclosure relates to a work implement as well as to methods for carrying out a working step by means of such a work implement.

BACKGROUND

Diaphragm walls are used in civil engineering, among other things, to secure excavation pits. To create such a diaphragm wall, a vertical slot is usually first excavated from the ground along guide walls, which is then concreted with reinforced concrete. The resulting diaphragm wall supports the further foundation of the structural plant.

SUMMARY

For the excavation of such diaphragm walls, typically cable dredgers with diaphragm wall cutters or alternatively with special clamshell buckets, so-called diaphragm wall buckets, are used. There are two main types of diaphragm wall gripper: mechanical diaphragm wall grippers and hydraulic diaphragm wall grippers. In the case of hydraulic diaphragm wall grippers, the gripper buckets are actuated hydraulically, while in the case of mechanical diaphragm wall grippers, the opening and closing of the gripper buckets takes place via a cable pull system by means of a closing cable provided for this purpose.

Hydraulic diaphragm wall grippers are becoming increasingly popular and widespread due to their ease of operation, e.g. by means of a hydraulic rotary cylinder on the gripper head. However, in addition to their ease of operation, hydraulic diaphragm wall grippers also have some disadvantages compared to mechanical diaphragm wall grippers. For example, in order to operate the hydraulic gripper, the hydraulic supply for the gripper must be provided at a bulkhead plate of the cable excavator, which then has to be routed to the gripper head via hose reels at a depth of up to 50 m in addition to the steel cables. The hose reels required for this are cost-intensive and maintenance-prone.

A mechanical diaphragm wall gripper is typically suspended from the carrier by only two steel cables (hoisting cable and closing cable). The mechanical diaphragm wall gripper is thus underactuated in contrast to the hydraulic diaphragm wall gripper, since the movement of three degrees of freedom (hoisting/lowering of the diaphragm wall gripper, rotation of the diaphragm wall gripper and opening/closing of the gripper buckets) is actuated with only two winches (hoisting cable winch and closing cable winch).

Excavation of a slot with a mechanical diaphragm wall gripper is carried out in cyclical digging operations. For this purpose, the soil to be excavated is first loosened and then transported to a material discharge point. To achieve the desired digging depth in a minimum number of cycles, the diaphragm wall gripper must be filled to the maximum in each cycle. Threading the gripper into the slot is usually the longest working phase.

The present disclosure is based on the object of facilitating the operation of a generic mechanical diaphragm wall gripper. In particular, the operator is to be assisted in carrying out the work steps, thereby increasing the ease of operation and the efficiency of the work process.

According to the disclosure, this object is achieved by a work implement and/or method having the features described herein.

Accordingly, on the one hand, and work implement is proposed, in particular a cable excavator, which comprises a mechanical diaphragm wall gripper with two gripper buckets, which is suspended from the work implement via a hoisting cable and a closing cable. The hoisting cable serves to adjust the diaphragm wall gripper, in particular in a substantially vertical direction (with respect to gravity), while the closing cable serves to actuate, i.e. open or close, the gripper buckets.

Both cables can also be used to adjust the diaphragm wall gripper and/or to open or close the gripper buckets. In particular, both cables are wound or unwound together to adjust the diaphragm wall gripper. In addition, opening of the gripper buckets can be performed either by unwinding the closing cable or by winding up the hoisting cable, or a combination thereof. Likewise, closing of the gripper buckets can be accomplished either by winding up the closing cable or by unwinding the hoisting cable, or a combination thereof. Preferably, the closing cable is used to actuate the gripper buckets, which is guided in particular via a cable pull mechanism of the diaphragm wall gripper to enable a high closing force.

The work implement according to the disclosure further comprises a hoisting cable winch on which the hoisting cable is mounted so that it can be wound up and unwound, and a closing cable winch on which the closing cable is mounted so that it can be wound up and unwound. The cable winches are actuated in particular by corresponding actuators or motors.

Furthermore, the work implement according to the disclosure comprises a measuring device with at least one sensor for detecting a current position, speed and/or acceleration of at least one component of the work implement. This may concern the diaphragm wall gripper as a whole and/or one of the cables or both cables (or the corresponding winches or actuators).

Finally, the work implement according to the disclosure comprises a control unit connected to the measuring device, via which the hoisting and closing cable winches can be controlled, and at least one input means connected to the control unit for controlling the diaphragm wall gripper. The input means can be, for example, one or more joysticks and/or switches in a driver's cab of the work implement.

The term "control unit" should not be interpreted to mean a single unit or component, but can also refer to a system composed of several individual control units or computers communicatively connected to one another. The functions discussed below that are performed by the control unit may therefore be performed by a single unit or may be distributed among multiple units. However, for the sake of simplicity, only one control unit will be referred to in the following.

In the following, the terms "diaphragm wall gripper" and "gripper" are used synonymously.

According to the disclosure, the control unit is configured to control the hoisting cable winch and/or the closing cable winch via a cascade control in order to carry out a work step involving the diaphragm wall gripper (e.g. a hoisting/lowering of the diaphragm wall gripper, a rotation of the diaphragm wall gripper, an opening/closing of the gripper buckets or any combination thereof) depending on measurement data of the measuring device and of target specifications of the input means.

Cascade control in this context means control with the aid of several, i.e. at least two, nested control loops. In particular, an output variable of an outer or higher-level controller or control loop serves as a reference variable, i.e. as a target value of an inner or lower-level controller or control loop. In particular, the inner control loops are faster than the respective outer control loops.

The cascade control of the cable winches enables fast, precise and stable control of the movement process. Based on this control structure, an assistance system can be provided, for example by integrating automatic planning, which may also take into account physical limitations of the work implement or gripper, to support the user in operating the work implement and significantly increase operating comfort.

In one possible embodiment, it is provided that the cascade control comprises a lower-level control loop for controlling a rotary angle, a rotary angle velocity and/or a rotary angle acceleration of the hoisting and/or the closing cable winch as well as a higher-level control loop for controlling a position, speed and/or acceleration of the diaphragm wall gripper. Preferably, the cascade control comprises a lower-level control of the rotary angle velocities of the hoisting and closing cable winches as well as a higher-level control of the diaphragm wall gripper position, i.e. a higher-level position control.

In another possible embodiment, only drives or motors of the hoisting and closing cable winches are used as actuators for the cascade control. In particular, the said drives of the hoisting and closing cable winches are used as actuators for both the lower-level and the higher-level control loops. In particular, other actuators or control elements are not used, which simplifies the control.

In another possible embodiment, the control unit is configured to perform position control of the diaphragm wall gripper via several sub-controls, each using only two degrees of freedom of the diaphragm wall gripper. In other words, the position control is divided into two reduced subsystems or sub-controls, each with only two degrees of freedom of movement. This means that the underactuated control task for moving the diaphragm wall gripper can be divided into two exact, i.e. not underactuated, subproblems.

Preferably, one of the sub-controls concerns a position of the gripper buckets and a position, in particular a vertical position, of the diaphragm wall gripper. Alternatively or additionally, one of the sub-controls concerns an orientation, in particular a rotary angle, and a position, in particular a vertical position, of the diaphragm wall gripper.

In particular, the position control is divided into the two aforementioned sub-controls, since these movement processes (in particular the actuation of the gripper buckets and the rotation of the diaphragm wall gripper) are usually not performed simultaneously, but one after the other. For example, the diaphragm wall gripper is rotated about its vertical axis for threading into the guide walls in a first mode of the position control. Subsequently, the diaphragm wall gripper is lowered into the slot, where the gripper buckets are then opened or closed in a second mode of position control. Here, the rotation of the diaphragm wall gripper during opening and closing is neglected in particular. This is justified during opening since the rotation of the gripper is blocked by the slot anyway. Likewise during emptying of the gripper, where the rotation of the gripper hardly influences the process. Thus, exact control of the movement processes is only possible with the two cable winches without interference.

Thus, the first mode may enable lifting or lowering as well as rotation of the closed gripper and may be referred to as "turning". The second mode can enable lifting or lowering as well as opening or closing of the gripper and can be referred to as "gripping".

This division allows the position control to be implemented as a switching trajectory sequence control. The respective trajectory sequence control can be selected, for example, using a switching logic depending on the requirement of the gripper opening and the current gripper opening. Preferably, the position control can be in the first mode (turning) by default and follow the corresponding target specifications of the closed gripper. It can be provided that, as soon as the opening of the gripper is requested by the operator, the position control automatically changes to the second mode ("gripping") and then follows the now applicable target specifications. Preferably, the rotation of the opened gripper is ignored. It can be provided that the position control automatically switches back to the first mode ("rotating") as soon as the gripper is completely closed again.

In another possible embodiment, the control unit is configured to control a position of the diaphragm wall gripper via the cascade control, wherein the hoisting and/or closing cable winches can be pilot-controlled via a pilot control means, which is configured to specify and/or change a position, in particular a trajectory, of the diaphragm wall gripper on the basis of target specifications of the input means and a mathematical model. Preferably, the feedforward means comprises or represents a trajectory generator and/or trajectory filter. The feedforward means can be configured to process the operator's input via the input means and to generate a target trajectory for the cascade control, in particular for a higher-level position control.

In another possible embodiment, it is provided that for the cascade control, only rotary angles of the hoisting and closing cable winches and a rotary angle velocity and/or orientation (in particular a rotary angle) of the diaphragm wall gripper are measured by means of the measuring device. In particular, it is not necessary to detect other measured variables for the control according to the disclosure.

In another possible embodiment, it is provided that at least one control loop of the cascade control, preferably all control loops, comprises a PI controller. Alternatively or additionally, at least one controller can be configured as a feedforward controller with an additional PD controller, for example for higher-level position control.

In another possible embodiment, an estimator connected to the measuring device is provided, which is configured to determine a current position, speed and/or acceleration of the diaphragm wall gripper on the basis of measurement data from the measuring device. The measurement data input into the estimator may be angles of rotation of the winches and/or a rotational speed of the diaphragm wall gripper. Preferably, the estimator comprises a Kalman filter, in particular an extended Kalman filter with state constraint. In particular, the estimator represents a state observer or virtual sensor for estimating the exact position or orientation of the diaphragm wall gripper from the acquired measurement data. In other words, the estimator preferably reconstructs a current state of the diaphragm wall gripper from the measurement data since this state in particular cannot be measured directly. The estimator may represent a separate unit connected to the control unit or may be part of the control unit (e.g. as a software module).

In another possible embodiment, the diaphragm wall gripper is not guided on a leader, but is suspended, in particular freely suspended, on a boom of the work implement via the hoisting and closing cables. The movement of the diaphragm wall gripper is effected by actuating the hoisting and closing cables.

In another possible embodiment, it is provided that hoisting, lowering, opening, closing and/or rotating of the diaphragm wall gripper is performed exclusively by actuation of the hoisting and/or closing cable winches.

In a further possible embodiment, it is provided that the hoisting cable and the closing cable are each configured as non-twist-free cables, in particular as stranded cables made of steel. The cables preferably have opposite lay directions. Each cable generates a torsional torque depending on its cable tension. The two cables twist in opposite directions as a result of their opposite lay directions and attachment to the diaphragm wall gripper. Depending on the force distribution between the cables, this allows the diaphragm wall gripper to be rotated preferably in the range of ±180°.

The disclosure further relates to a method for carrying out a working step by means of a work implement according to the disclosure. The method comprises the following steps (which do not necessarily have to be carried out in the specified order):

- Generation of at least one target specification for carrying out the work step, in particular by actuation of the input means,
- Detection of at least one current position, speed and/or acceleration of the hoisting cable winch and/or the closing cable winch, in particular by means of one or more sensors of the measuring device, and
- Regulation and preferably control (in particular pilot control) of the hoisting cable winch and/or the closing cable winch by the control unit on the basis of measurement data from the measuring device and the at least one target specification in such a way that the diaphragm wall gripper moves in accordance with the at least one target specification.

With regard to the features, advantages and possible embodiments of the work implement, the previous explanations apply analogously, so that a repetitive description is largely dispensed with.

In one possible embodiment, it is provided that, within the scope of a lower-level control, a rotary angle, a rotary angle velocity and/or a rotary angle acceleration of the hoisting cable winch and/or the closing cable winch and, within the scope of a higher-level control, a position, speed and/or acceleration of the diaphragm wall gripper (directly or indirectly via the position, speed and/or acceleration of the winch(es)) is/are controlled, wherein the hoisting cable winch and/or the closing cable winch is/are preferably controlled via a model-based feedforward control in addition to the control. Preferably, there is a lower-level control of the rotary angle velocities of the hoisting and closing cable winches as well as a higher-level control of the diaphragm wall gripper position, i.e. a higher-level position control.

In a further possible embodiment, it is provided that a position control of the diaphragm wall gripper is carried out on the basis of only two degrees of freedom, which preferably differ from each other for at least two different working steps involving the diaphragm wall gripper. Preferably, a partial control concerns a position of the gripper buckets and a position, in particular vertical position, of the diaphragm wall gripper. Alternatively or additionally, a partial control relates to an orientation, in particular a rotary angle, and a position, in particular a vertical position, of the diaphragm wall gripper.

In another possible embodiment, it is provided that a current position of the diaphragm wall gripper is determined or estimated by an estimator and provided to the control unit for a position control of the diaphragm wall gripper, in particular as an actual value.

BRIEF DESCRIPTION OF THE FIGURES

Further features, details and advantages of the disclosure will be apparent from the examples of embodiments explained below with reference to the figures. The Figures show in:

FIG. 1: an embodiment of the work implement according to the disclosure in a side view of;

DETAILED DESCRIPTION

Figure 1:
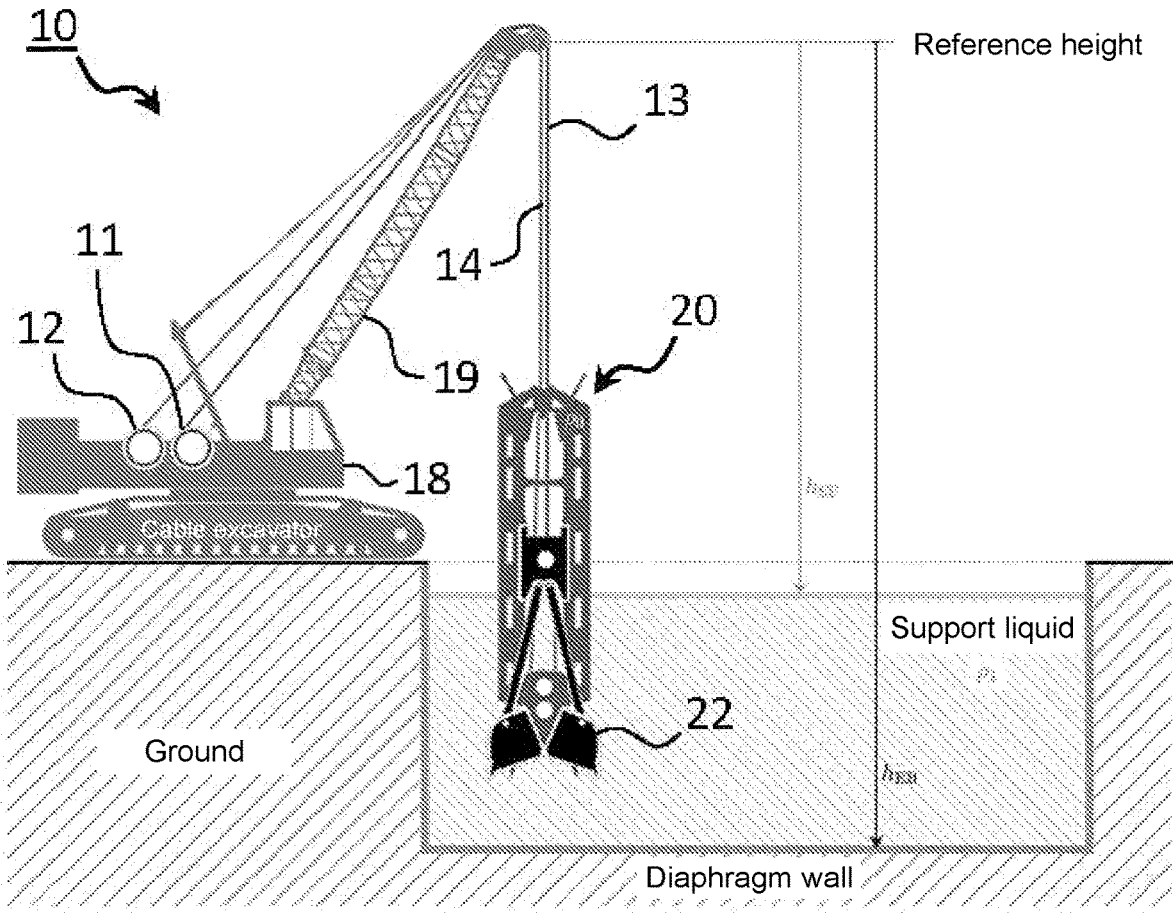

FIG. 1 shows a side view of an embodiment of the work implement 10 according to the disclosure, wherein the ground as well as a ground slot created in the ground and filled with a support liquid are shown in a schematic sectional view. In the exemplary embodiment shown here, the work implement 10 is a cable excavator 10 having an undercarriage comprising a crawler chassis, an upper carriage 18 mounted thereon about a vertical axis of rotation, and a lattice boom 19 pivotally mounted on the upper carriage 18. In FIG. 1, the height is referenced with respect to the vertical direction relative to gravity.

A mechanical diaphragm wall gripper 20 is suspended from the boom 19 via two steel cables, which are guided to the upper carriage 18 via corresponding pulleys on a boom head: a hoisting cable 13, which is mounted on a hoisting cable winch 11 attached to the upper carriage 18 so that it can be wound and unwound, and a closing cable 14, which is mounted on a closing cable winch 12 also attached to the upper carriage 18 so that it can be wound and unwound.

At the lower end, the diaphragm wall gripper 20 comprises two gripper buckets 22 pivotably mounted on a gripper frame, which can be opened and closed by actuating the closing cable 14 (or the closing cable winch 12). The gripper buckets 22 are hinged to a body 26 and connected to a gripper slide 27 via rods not shown. The closing cable 14 is stepped down in the gripper via a pulley block or cable pull system 24 (cf. FIG. 2) in order to achieve a higher closing force, and is attached at one end to a gripper slide 27 of the diaphragm wall gripper 20. The hoist cable 13 is attached directly (i.e. without a cable pull system) to the gripper slide 27. The deflection pulleys of the cable pull system 24 are preferably connected partly to the gripper slide 27 and partly to the body 26.

The diaphragm wall gripper 20 hangs freely on the boom 19 so that all movements (hoisting, lowering, rotating about a vertical axis and opening/closing of the gripper buckets 22) are performed only by activating the hoisting and closing cable winches 11, 12. The hoisting and closing cable winches 11, 12 are in particular identical in construction.

Non-twisting steel strand cables with opposite lay directions are used for the two cables 13, 14. No external forces act on the diaphragm wall gripper 20 outside the ground slot. However, as soon as the diaphragm wall gripper 20 is immersed in the support liquid, which is introduced into the bottom slot, the rotation of the diaphragm wall gripper 20 is blocked by the guide walls. In addition, a buoyancy force acts through the support liquid and as soon as the gripper shells 22 reach the ground, the total potential forces are compensated.

The boom position of the cable excavator 10 is assumed to be fixed for the following discussion. The excavator may include a control unit, which may be represented by a rectangular box in the excavator, having a processor and memory with instructions stored thereon for carrying out the control methods described herein based on signals received from sensors (or measuring devices) described herein and by sending output signals to actuators as described herein.

Figure 2:
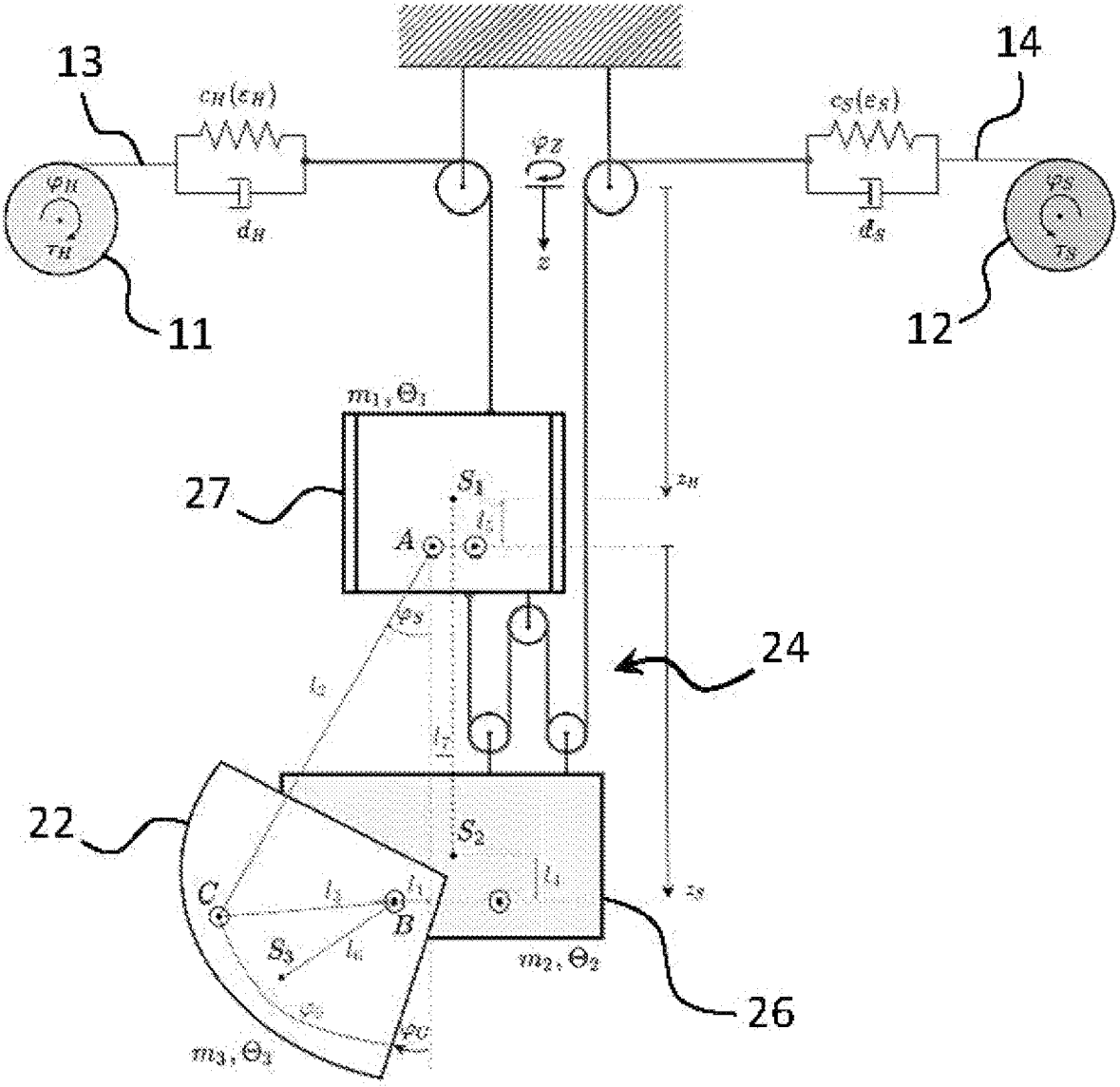
FIG. 2: a schematic representation of the components and variables relevant for cascade control of the work implement according to the disclosure according to an embodiment.

FIG. 2 shows a schematic representation of the components and variables of the work implement according to the disclosure that are relevant for the cascade control, wherein in particular the generalized coordinates and dimensions for the gripper 20 can be seen. For modeling purposes, the overall system is divided into the three subsystems: drive train, cable system and mechanical gripper 20 (in the following, the terms "diaphragm wall gripper" and "gripper" are used synonymously).

The first subsystem comprises the two drive trains of the working winches 11, 12 of the cable excavator 10. For each drive train, a linear replacement model comprising a motor, a gearbox and the respective winch drum 11, 12 is used.

In the gripper operation of the mechanical diaphragm wall gripper 20, two non-rotation-free stranded steel cables with opposite lay directions are used as hoisting and closing cables 13, 14. For modeling purposes, the elasticity as well as the torsion of the hoisting and closing cables 13, 14 is preferably taken into account. The use of non-rotational cables 13, 14 makes it possible to rotate the mechanical diaphragm wall gripper 20 about the vertical axis. In doing so, each cable 13, 14 generates a torsional torque depending on its cable tension. The two cables 13, 14 torsion in opposite directions due to their opposite direction of lay and attachment to the gripper 20. Thus, depending on the force distribution between the cables 13, 14, the gripper 20 can be rotated in the range of ±180°.

The third subsystem describes the mechanical diaphragm wall gripper 20 itself, which is actuated via the hoisting and closing cables 13, 14. The diaphragm wall gripper 20 is operated by controlling the two winches 11, 12. To close the gripper 20 or the gripper buckets 22, the closing cable 14 is retracted. When the gripper 20 is completely closed (a lower stop is preferably provided for this purpose), further retraction of the closing cable 14 causes the entire gripper 20 to lift in the closed state, with the entire load resting on the closing cable winch 12. When the gripper 20 or the gripper buckets 22 are opened to the maximum, the gripper buckets 22 are at an end stop and further unwinding of the closing cable 14 does not result in any further movement of the gripper 20, but only in a loosening of the closing cable 14. For lifting in the closed state without undesired opening of the gripper buckets 22, the lower stop must therefore never be left. The same applies analogously to lowering the gripper 20 in the open state.

In addition to the gripper height and the opening angle of the gripper buckets 22, the gripper 20 can be rotated about a vertical axis via the torsional moment of the cables 13, 14 described above. When opening or closing the gripper 20, this also results in an inevitable rotation of the gripper 20.

The coordinates of the gripper 20 are determined by the cable lengths of the hoisting and closing cables 13, 14 and the angle of rotation $\varphi_S$ of the gripper 20 about the vertical axis. To derive the equations of motion, the generalized coordinates according to FIG. 2 are also introduced. For the lower-level control concept, the equations of motion of the overall system can advantageously be divided into actuated coordinates $$q_A^T = [\varphi_H, \varphi_S]$$

and unactuated coordinates $$q_U^T = [z_H, z_S, \varphi_Z].$$

Thus, the equations of motion can be derived on the basis of the energies and by applying the Lagrange formalism.

Figure 3:
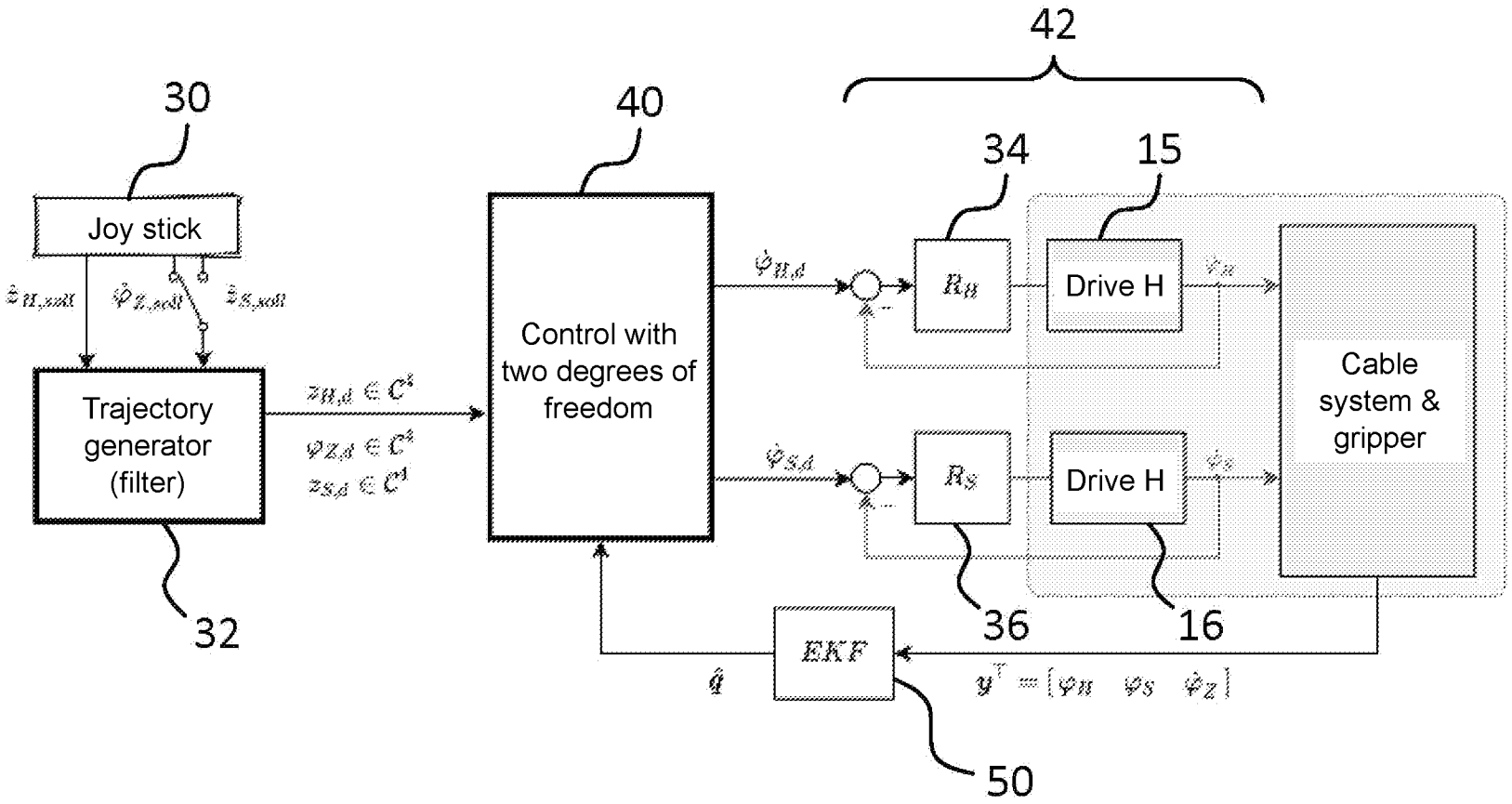
FIG. 3: a block diagram of the cascade control according to an exemplary embodiment.

FIG. 3 shows a block diagram of the cascade control system according to the disclosure. FIG. 3 will now be used to explain the control system according to the disclosure in the context of a configuration example.

I. Overview

By operating a joystick 30 (=input means) in the operator's cabin of the crawler excavator 10 to perform a working movement of the diaphragm wall gripper 20, target specifications $\dot{z}_{H,soll}, \dot{z}_{S,soll}, \dot{z}_{Z,soll}$ are generated. These values are made available to a trajectory generator or planner 32, which calculates the setpoint values $z_{H,d}$, $z_{S,d}$, $\varphi_{Z,d}$ actually used for control on the basis of a mathematical model, taking into account the physical limitations of the gripper system. The actual values for the control are acquired by sensors of a measuring system and provided to an estimator 50 acting as a state observer, which uses them to estimate the current position and/or orientation of the diaphragm wall gripper as actual values actually used in the control.

In cascade control, lower-level control of rotary angle velocity is performed via a lower-level control loop 42, with the motors or drives 15 and 16 of the hoisting and closing cable winches 11, 12 serving as actuators. Two PI controllers 34, 36 are used as controllers. The rotary angle velocities $\dot{\varphi}_H$ and $\dot{\varphi}_s$, are determined on the basis of the motor torques $\tau_{M,H}$ and $\tau_{M,s}$ controlled by the lower-level motors 15, 16.

A higher-level control loop 40 is used to control the position of the diaphragm wall gripper 20. A division of the underactuated system into two reduced subsystems enables higher-level (two degrees of freedom) position control. Here, too, the motors or drives 15 and 16 of the hoisting and closing cable winches 11, 12 serve as actuators. The higher-level control loop 40 may comprise a feedforward control with at least one additional PD controller.

In this embodiment, the higher-level position control is configured as a switching position control for the unactuated subsystem. The trajectory planner 32 processes the operator's input and generates the target trajectory $z_{H,d}$, $z_{S,d}$, $\varphi_{Z,d}$. The state observer 50 is used to reconstruct the state from the measured variables $y^T$. The measured variables $y^T$ of the system are the rotary angles $\varphi_H$, $\varphi_S$ of the cable winches 11, 12 and the rotational speed $\dot{\varphi}_Z$ of the gripper. With the aid of the estimate and the target trajectory, the target velocity $\dot{\varphi}_H$, $\dot{\varphi}_s$ is specified for the lower-level speed control in the position control.

Lifting and lowering of the diaphragm wall gripper 20 and rotation about its vertical axis (vertical in FIG. 1) are typically performed with the gripper buckets 22 fully closed (or perhaps open). This allows the position control of the three degrees of freedom of the gripper 20 to be split into two separate controls, each with only two degrees of freedom. Thus, the (underactuated) control task can be divided in the form of two exact subproblems:

Subproblem 1: Opening/closing the gripper 20 and its vertical movement: In this mode, a virtual output $[z_H, \varphi_s]$ is used for position control. Together with a mathematical model, a model-based feedforward control can be calculated.

Subproblem 2: Gripper rotation in the stop and vertical movement: Targeted gripper rotation is required primarily when threading the gripper 20 into the ground slot. These maneuvers are performed with the gripper buckets 22 closed (or open). In this mode, a virtual output $[z_H, \varphi_z]$ is specified for the position control. Again, a model-based feedforward can be determined based on the aforementioned mathematical model.

In order to be able to follow the specified trajectory even in the case of model or parameter deviations, PD controllers are preferably added to both feedforward controls.

For the stabilization of the trajectory, which is planned in the unactuated coordinates $q_{U,d}$ the unactuated coordinates q and their time derivatives are required. To estimate these system parameters from the measurable output, the mentioned estimator 50 can be used in the form of an extended Kalman filter with state constraint.

For the determination of the manipulated variables (motor speeds), the two feedforward controls require two trajectories that can be continuously differentiated. In addition, these trajectories should be limited in their derivatives so that the available manipulated variables can be used optimally. This planning is done by means of state variable filters.

II. The individual components of the cascade control system according to the disclosure are explained in more detail below.

1. Controller Model

For the control, in particular the frictions in the cable forces are neglected. In addition, the effect of the slot on the gripper 20 is neglected and thus it is assumed that the diaphragm wall gripper 20 moves in free space.

2. Lower-Level Speed Control

According to the disclosure, a cascaded controller structure is selected for the trajectory sequence control. For this purpose, a lower-level speed control is configured for both motors, which controls the requested speed. The higher-level control loop thus approximately receives the velocities $\dot{\varphi}_H$, $\dot{\varphi}_s$, as new input variables. For the design of the speed control systems, the cable forces in particular are considered as a disturbance. Thus, linear system dynamics are obtained for the drive train and, in particular, a PI controller is dimensioned using the frequency characteristic method.

3. Position Control

In the context of position control, a distinction is made between two modes:

i) Operation of the closed gripper 20—first mode. Threading into the slot requires control over the rotation of the closed gripper 20 as well as hoisting/lowering. Further, for lifting out the removed material, it is important that the gripper 20 remains closed until the material discharge point is reached. This first mode, which enables lifting or lowering as well as rotation of the closed gripper 20, will be referred to as "Rotate" mode in the following.

ii) Operation of the gripper mechanism—second mode. The rotation $\varphi_Z$ of the gripper 20 during opening or closing is neglected. This functionality is needed when digging inside the slot. In this case, the rotation of the gripper 20 is blocked by the slot anyway. Likewise, when emptying the gripper, where the rotation of the gripper 20 hardly affects the process. This second mode, which allows the gripper 20 to be raised or lowered and opened or closed, is referred to below as the "gripping" mode.

This division allows the position control to be implemented as a switching trajectory follower control (TFR). The basis for the design are the unactuated subsystems of the models. A switching logic is used to select the respective trajectory sequence control depending on the requirement of the gripper opening and the current gripper opening.

Preferably, the position control is in the first mode by default and thus follows the two setpoints of the closed gripper 20. As soon as the operator requests the opening of the gripper 20, the position control automatically switches to the "gripping" mode and thus follows the now valid setpoints. The specification of the rotation of the opened gripper is ignored and the rotation of the gripper 20 follows the system dynamics. As soon as the diaphragm wall gripper is completely closed again, it is preferable to switch back automatically to the Rotate mode.

4. Implementation and Robustness of the TFR

To increase robustness, the target trajectory and its time derivatives are used for the evaluation of the state feedbacks instead of the actual quantities or their estimation. For the trajectory errors in the state control laws, the deviations of the target trajectories with the non-measurable state variables as well as their time derivatives are required. Since these quantities are not accessible to any measurement, the already mentioned state observer 50 is used and the estimated states are used for the stabilization. By evaluating at the target trajectories, the state feedbacks correspond to (flatness-based) feedforward controls and by adding the state control laws, a two-degree-of-freedom control is obtained.

Preferably, the effect of the slot on the gripper 20 is neglected in the control. However, blocking the rotation in the slot can cause a permanent control deviation, which has a negative effect on the control. The same applies to neglecting the buoyancy forces and reaching the bottom of the slot. To make the assistance system more robust in these cases, the state feedbacks can be disabled by setting the parameters to zero as long as the diaphragm wall gripper 20 is inside the diaphragm. The two-degree-of-freedom control thus simplifies to a pure (flatness-based) feedforward control.

5. State Observer

To implement the aforementioned switching trajectory tracking control, the non-measurable states and their time derivatives must be estimated. For this purpose, a state observer 50 is used. This can be configured, for example, as a discrete-time and state-constrained extended Kalman filter (EKF) for the full and the replacement model. In particular, switching between the EKFs is based on the estimated states. The EKF can be based on a discrete-time, state-constrained algorithm, which preferably comprises a prediction step and a correction step.

For the implementation of the observer, two EKFs are preferably used, which are switched depending on the estimated model state. In addition, when dipping into the slot, the rotation of the gripper 20 is preferably blocked via a state constraint in the observer. Switching is performed in particular on the basis of the estimated position or the estimated cable force of the closing cable 14. The last estimated state of the EKF to be switched off can be used as the start value of the EKF to be switched on.

6. Trajectory Planning

The position control requires, in particular, triple continuously differentiable target trajectories of the gripper coordinates. The following describes the specification of the target positions by the operator and the subsequent trajectory planning with trapezoidal acceleration profiles.

The target position for trajectory planning is specified in particular by three control signals from the operator. The operator preferably specifies the target position with a first control signal. This means that the height of the gripper buckets or the gripper body is specified with this control signal, which is more advantageous for the operator than specifying the height of the gripper slide 27. A second control signal preferably specifies the gripping directly via a corresponding coordinate. With a third control signal, the operator specifies in particular the target angle for the gripper rotation. The three trajectory generators (TG) preferably differ only in their constraints and provide the triple continuous target trajectories.

The setpoint trajectories must be restricted in their derivatives so that, on the one hand, the manipulated variable restrictions of the motors are observed and, on the other hand, the closed gripper 20 does not open unintentionally during rotary movements. For this purpose, the conditions for switching the model structure are considered on the basis of the cable forces in the stationary case. In the stationary case, the cable forces compensate for the potential forces. Thus, the possible force distributions of the cables lie on the straight line between two extreme points. In a first extreme point, the entire weight of the gripper 20 hangs on the closing cable 14 and this is therefore in the closed stop with maximum torsional moment. Conversely, at a second extreme point, the entire weight of the gripper 20 is suspended from the hoist cable 13 and the latter is therefore in the open stop. In an intermediate point located between the two mentioned extreme points on the mentioned straight line, the gripper 20 leaves the stop and a switching from the replacement models to the complete model takes place. By determining the critical cable force and thus the position of the intermediate point, a lower limit of the closing cable force can be specified, which must not be undershot during operation of the closed gripper 20.

Furthermore, the constraints of the cable forces can be converted to constraints of the rotational acceleration. This means that a minimum (negative) rotational acceleration and a maximum (positive) rotational acceleration can be determined for the trajectory planning of the closed gripper by differentiating between the two extreme points mentioned. The conversion depends on the current angle of rotation due to the torsional moments and the restoring moment and would have to be determined depending on the planned nominal trajectory. For the implementation, the average angle of rotation between the start and end point is preferably used as an approximation.

In summary, the system shown in this embodiment forms an assistance system that simplifies the operability of the mechanical diaphragm wall gripper 20 for the excavator operator. The assistance system supports the excavator operator in operating the cable excavator 10 by controlling the two cable winches 11, 12 depending on the work step, based on a model-based control. A trajectory generator 32 takes physical constraints into account and implements the respective work steps (hoisting/lowering, turning, opening/closing). The non-measurable state variables are determined via an observer (virtual sensor) 50.

LIST OF REFERENCE CHARACTERS

10 Work implement (cable excavator)
11 Hoisting cable winch
12 Closing cable winch
13 Hoisting cable
14 Closing cable
15 Actuator/motor
16 Actuator/motor
18 Upper carriage
19 Boom
20 Diaphragm wall gripper
22 Gripper bucket
24 Cable pull system
26 Body
27 Gripper slide
30 Input means
32 Trajectory generator
34 PI controller
36 PI controller
40 Higher-level control loop
42 Lower-level control loop
50 Estimator (extended Kalman filter)

The invention claimed is:

1. Work implement, comprising a mechanical diaphragm wall gripper with two gripper buckets, which is suspended on the work implement by means of a hoisting cable and a closing cable, a hoisting cable winch, on which the hoisting cable is mounted so that the hoisting cable can be wound up and unwound for adjusting the diaphragm wall gripper, a closing cable winch, on which the closing cable is mounted so that the closing cable can be wound up and unwound for actuating the gripper buckets, a measuring device with at least one sensor for detecting a current position, speed and/or acceleration, a control unit connected to the measuring device, by means of which the hoisting and closing cable winches can be actuated, as well as an input means connected to the control unit for controlling the diaphragm wall gripper, wherein the control unit is configured to control the hoisting cable winch and/or the closing cable winch by means of a cascade control in order to carry out a working step involving the diaphragm wall gripper depending on measurement data from the measuring device and on target specifications of the input means.

2. Work implement of claim 1, wherein the cascade control comprises a lower-level control loop for controlling an angle of rotation, a rotary angle velocity, and/or a rotary angle acceleration of the hoisting cable winch and/or the closing cable winch, and a higher-level control loop for controlling a position, velocity, and/or acceleration of the diaphragm wall gripper.

3. Work implement according to claim 1, wherein only drives of the hoisting and closing cable winches are used as actuators for the cascade control.

4. Work implement according to claim 1, wherein the control unit is configured to carry out a position control of the diaphragm wall gripper via a plurality of partial controls on the basis of in each case only two degrees of freedom of the diaphragm wall gripper, wherein one partial control relates to a position of the gripper buckets and a vertical position of the diaphragm wall gripper and/or one partial control relates to an orientation, including angle of rotation, and a position, including vertical position, of the diaphragm wall gripper.

5. Work implement according to claim 1, wherein the control unit is configured to regulate a position of the diaphragm wall gripper via the cascade control, wherein the hoisting and/or closing cable winches can be pilot-controlled via a pilot control means, which is configured to preset and/or change a position of the diaphragm wall gripper on the basis of target specifications of the input means and a mathematical model, wherein the pilot control means represent or comprise a trajectory generator and/or filter.

6. Work implement according to claim 1, wherein only angles of rotation of the hoisting and closing cable winches as well as a rotary angle velocity and/or orientation of the diaphragm wall gripper are measured by means of the measuring device for the cascade control.

7. Work implement according to claim 1, wherein at least one control loop of the cascade control comprises a PI controller.

8. Work implement according to claim 1, further comprising an estimator connected to the measuring device, which is configured to determine a current position, velocity and/or acceleration of the diaphragm wall gripper on the basis of measurement data of the measuring device.

9. Work implement according to claim 1, wherein the diaphragm wall gripper is not guided on a leader, but is freely suspended on a boom of the work implement via the hoisting and closing cables.

10. Work implement according to claim 1, wherein hoisting, lowering, opening, closing, and/or rotating of the diaphragm wall gripper is performed only by actuation of a hoisting cable winch, a closing cable winch, or both.

11. Work implement according to claim 1, wherein the hoisting cable and the closing cable are each formed as non-twist-free cables.

12. Method of performing a working step by means of a work implement according to claim 1, comprising the steps:

generation of at least one target specification for performing the working step, detection of at least one current position, speed and/or acceleration of the hoisting cable winch and/or the closing cable winch, regulation of the hoisting cable winch and/or the closing cable winch by the control unit on the basis of measurement data and the at least one target specification in such a way that the diaphragm wall gripper moves in accordance with the at least one target specification.

13. Method according to claim 12, wherein a rotary angle, a rotary angle velocity and/or a rotary angle acceleration of the hoisting cable winch and/or the closing cable winch is controlled within the scope of a lower-level control and a position, speed and/or acceleration of the diaphragm wall gripper is controlled within the scope of a higher-level control.

14. Method according to any claim 13, wherein a position control of the diaphragm wall gripper is performed on the basis of only two degrees of freedom, which differ from each other for at least two different working steps involving the diaphragm wall gripper.

15. Method according to claim 12, wherein a current position of the diaphragm wall gripper is determined by an estimator from measurement data and is provided to the control unit for a position control of the diaphragm wall gripper.

* * * * *